US005196730A

United States Patent [19]

Matsuo

[11] Patent Number: 5,196,730

[45] Date of Patent: Mar. 23, 1993

[54] ARRANGEMENT OF AUTOMATICALLY RESTORING NORMAL OPERATION OF LATCH-IN RELAY

[75] Inventor: Ryuji Matsuo, Tokyo, Japan

[73] Assignee: NEC Corporation, Tokyo, Japan

[21] Appl. No.: 559,613

[22] Filed: Jul. 30, 1990

[30] Foreign Application Priority Data

Jul. 31, 1989 [JP] Japan ..... 1-199621

[51] Int. Cl.[5] ..... H01H 47/00

[52] U.S. Cl. ..... 307/132 EA; 361/153; 361/186

[58] Field of Search ..... 307/132 R, 132 EA; 361/153, 160, 170, 179, 186

[56] References Cited

U.S. PATENT DOCUMENTS 4,455,587 6/1984 Pothof et al. ..... 361/160
4,661,766 4/1987 Hoffman et al. ..... 361/160
4,907,122 3/1990 Tamura ..... 361/186
4,914,315 4/1990 Nickolai ..... 361/170

*Primary Examiner*—Jeffrey A. Gaffin
*Attorney, Agent, or Firm*—Laff, Whitesel, Conte & Saret

[57] ABSTRACT

In order to automatically restore a normal switching position of a relay armature from an accidental OFF switching induced by external impact or the like, the output of the relay is monitored and is applied to a differentiating circuit. A comparator is provided to reflect on and off operations of a main switch. In the event that the output of the relay falls suddenly, the differentiating circuit outputs a pulse to a wave-shaping circuit (e.g., Schmitt trigger). A gate circuit is supplied with the outputs of the wave-shaping circuit and the comparator. The output of the gate circuit momentarily allows a relay driver to actuate the relay in response to the undesired change in relay status, and hence the relay armature resumes ON switching position.

10 Claims, 4 Drawing Sheets

ARRANGEMENT OF AUTOMATICALLY RESTORING NORMAL OPERATION OF LATCH-IN RELAY

BACKGROUND OF THE INVENTION

1. Field of the Invention

The present invention relates generally to an arrangement of automatically restoring normal operation of a latch-in (or latching) relay, and more specifically to such an arrangement which features a self restoration function by which a latch-in relay is capable of returning to a normal condition in the event that a relay armature accidentally switches from ON position to OFF position in response to an external impact or the like which is applied thereto.

2. Description of the Prior Art

It is well known in the art that a latch-in relay maintains its contacts in the last position assumed, even without coil energization. A relay armature which forms part of a latch-in relay, switches to the ON position thereof in response to a rapidly rising voltage applied to the relay. Contrarily, when the relay is to be rendered inoperative, the opposite polarity of rapidly changing voltage is applied to the relay and hence the relay armature switches back to the OFF position thereof. A relay armature implies a movable electrically conducting arm.

In the event that a latch-in or latching relay accidentally breaks its contacts after being actuated, it is necessary to again apply actuation energy to make its contacts. Such unexpected contact breaking tends to occur with a latching type relay.

One of the conventional re-energizing circuitry for use in a latching relay circuit, has been disclosed in U.S. Pat. No. 4,907,122 assigned to the same entity as the instant application.

This prior art comprises, a pulse train oscillator, an output voltage sensing and oscillator disabling circuit, etc. The output of the relay circuit is constantly monitored by the output voltage sensing and oscillator disabling circuit. In the event that a relay armature accidentally switches to the OFF position thereof in response to an external impact or the like, an abrupt potential fall at the output of the relay circuit is detected and initiates the operation of the pulse oscillator. Thus, the relay is again supplied with a fast rising voltage and hence the rely armature restores to the ON position thereof. The output sensing and oscillator disabling arrangement, detects a normal output of the relay circuit and terminates the operation of the oscillator.

However, this prior art inherently requires the pulse oscillator as well as the arrangement for initiating and disabling the operation of the oscillator depending upon the output of the relay circuit. Consequently, this known technique has encountered a problem in that the circuit arrangement is complex and bulky.

SUMMARY OF THE INVENTION

It is an object of the present invention to provide a latch-in relay circuit which features a simple arrangement for restoring the normal relay operation in the event that the relay is rendered inoperative due to impact or like.

In brief, the above objects are achieved by an arrangement for automatically restoring a normal switching position of a relay armature from an accidental OFF switching induced by external impact or the like. The output of the relay is monitored and is applied to a differentiating circuit. A comparator is provided to reflect on and off operations of a main switch. In the event that the output of the relay falls suddenly, the differentiating circuit outputs a pulse to a wave-shaping circuit (e.g., Schmitt trigger). A gate circuit is supplied with the outputs of the wave-shaping circuit and the comparator. The output of the gate circuit momentarily allows a relay driver to actuate the relay in response to the undesired change in relay status, and hence the relay armature resumes ON switching position.

More specifically a first aspect of the present invention comes in a relay circuit comprising: a switch, the switch being coupled to a direct current voltage source; a latch-in relay, the latch-in relay including a relay armature and a contact controlling means, the relay armature being switched over between on and off positions thereof in response to voltage changes induced by the switch and applied to the contact controlling means; output voltage sensing means, the output voltage sensing means being responsive to an abrupt falling in potential at the output of the latch-in relay due to switching from on position to off position of the relay armature and generating a control signal representative of the abrupt falling in potential; and relay controlling means, the relay controlling means being coupled to the switch and being coupled to receive the control signal from the output voltage sensing means, the relay controlling means being responsive to the control signal indicating the abrupt falling in potential for changing the relay armature to the off position to the on position in the event that the switch remains closed.

A second aspect of the present invention comes in a relay circuit comprising: a switch, the switch being coupled to a direct current voltage source; a latch-in relay, the latch-in relay including a relay armature and a contact controlling means, the relay armature being switched over between on and off positions thereof in response to voltage changes induced by the switch and applied to the contact controlling means; a first gate circuit, the first gate circuit being provided with first and second inputs, the first input being coupled to an output of the latch-in relay and the second input receiving a predetermined voltage, the gate circuit outputting a first signal in response to an abrupt falling in potential at the output of the latch-in relay; a differentiating circuit, the differentiating circuit being coupled to the gate circuit and generating a control signal indicative of the abrupt falling in potential in response to the first signal; a comparator, the comparator being coupled to the switch and selectively outputting one of predetermined levels in response to closing and opening of the switch; a wave-shaping circuit, the wave-shaping circuit being coupled to the differentiating circuit and generating a rectangular pulse in response to the control signal indicating the abrupt falling in potential; a second gate circuit, the second gate circuit being coupled to the wave-shaping circuit and coupled to the comparator and generating a second signal whose voltage level changes in response to the rectangular pulse; and a relay driver, the relay driver coupled to the gate circuit and restoring the on position of the relay armature through the contact control means in response to the second signal.

BRIEF DESCRIPTION OF THE DRAWINGS

The features and advantages of the present invention will become more clearly appreciated from the following description taken in conjunction with the accompanying drawings in which like elements are denoted by like reference numerals and in which.

DETAILED DESCRIPTION OF THE PREFERRED EMBODIMENTS

Figure 1:
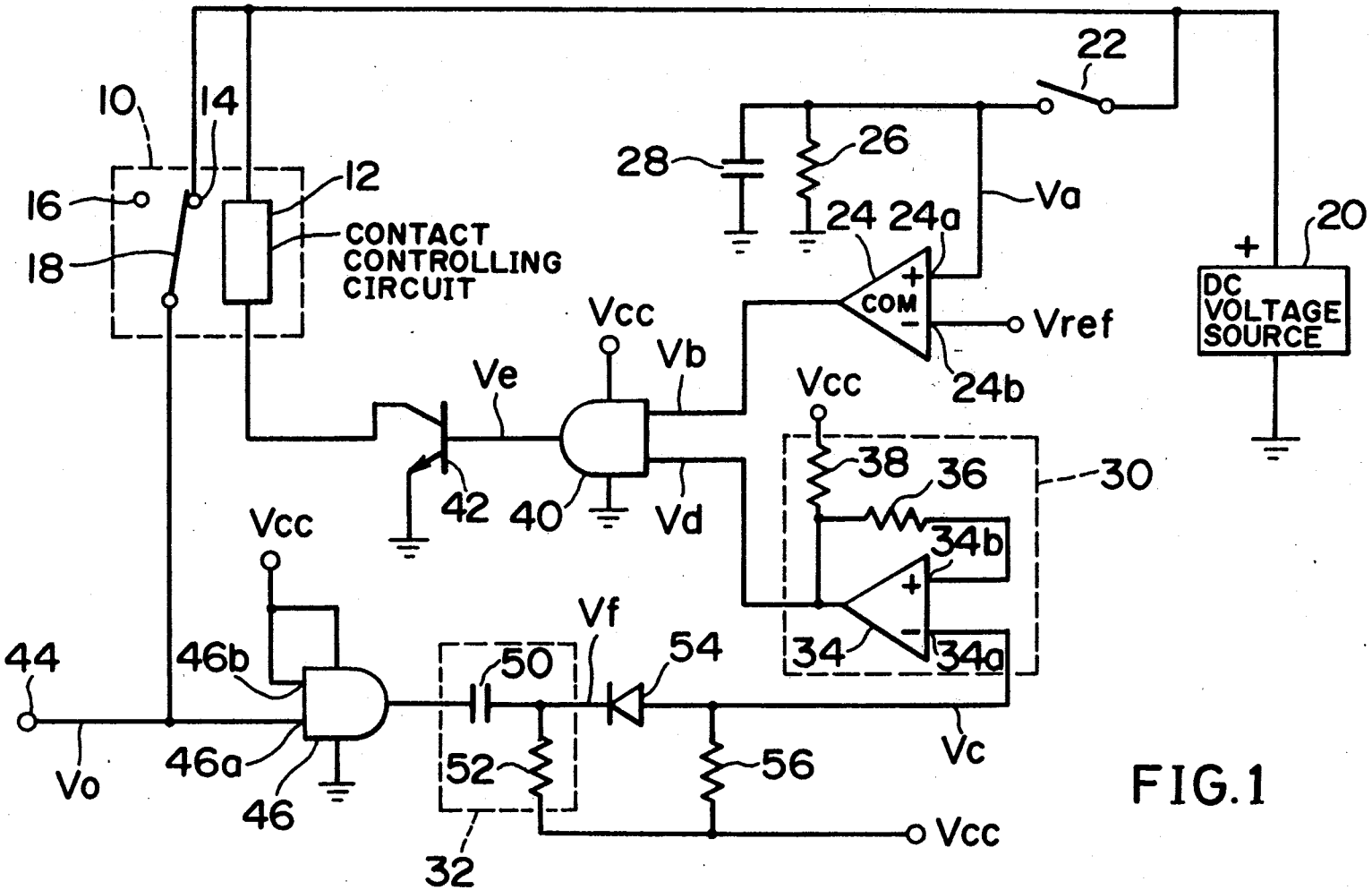
FIG. 1 is a block diagram showing an embodiment of this invention.

Reference is now made to FIG. 1, wherein an embodiment of this invention is shown in block diagram form. The FIG. 1 arrangement generally comprises, a latch-in relay 10, a direct current (DC) voltage source 20, a switch 22, a comparator 24, a wave-shaping circuit 30, and a differentiating circuit 32, etc.

The relay 10 is provided with a contact controlling circuit 12, ON and OFF position contacts 14 and 16, and a relay armature 18. One end of the contact controlling circuit 12 is coupled to the DC voltage source 20. Similarly, the ON position contact 14 is coupled to the DC voltage source 20.

As referred to in the opening paragraphs of the instant specification, the latch-in relay 10 maintains its contacts in the last position assumed, even without coil energization. More specifically, the relay armature 18 switches to the ON position contact 16 in response to a rapidly rising voltage applied from the DC voltage source 20 and remains in its position. Contrarily, when the relay 10 is to be rendered inoperative, the opposite polarity of rapidly changing voltage (viz., abrupt downward voltage change) is applied to the contact controlling circuit 12 and hence the relay armature 18 switches back to the OFF position contact 16.

The switch 22 is provided between the DC voltage source 20 and one input terminal 24*a* of the comparator 24. A reference voltage Vref is applied to the other input terminal 24*b* of the comparator 24. The reference voltage Vref is determined to be lower than a voltage level of a voltage Va when the switch 22 is closed. The comparator outputs a voltage Vb which takes a low or high level depending on the inputs voltages Va and Vref. A parallel circuit, which consists of a resistor 26 and a capacitor 28, is provided for absorbing undesirable voltage variations induced by a so-called "chattering" upon the switch 12 being closed.

The wave-shaping circuit 30 takes the form of a Schmitt trigger in this particular embodiment. As is well known, a Schmitt trigger produces pulse shaping by introducing positive feedback to obtain high gain and hysteresis. A Schmitt trigger produces an output when an input exceeds a specified turn-on level, while the output of the Schmitt trigger continues until the input falls below a specified turn-off level. As shown, the Schmitt trigger 30 is comprised of an operational amplifier 34 and two resistors 36, 38. The operational amplifier 34 has an inverting input 34*a* to which a voltage Vc is applied, while having a non-inverting input 34*b* coupled to the output of the amplifier 34 via the positive feedback resistor 36. A hysteresis width is determined by the resistors 36, 38. The wave-shaping circuit 30 outputs a voltage Vd having a rectangular wave shape.

An AND gate 40 is preceded by the comparator 24 and the wave-shaping circuit 30, and generates an output voltage Ve. A relay driving transistor 42 is rendered conductive upon the gate output Ve assuming a high level, and rendered inoperative when Ve assumes a low level. Thus, the driving transistor 42 supplies the contact controlling circuit 12 with rapidly rising and falling voltages thereby to render the relay 10 operative and inoperative, respectively.

The relay 10 is coupled to apply the output Vo thereof to an external circuit (not shown) via an output terminal 44, and also coupled to apply the output Vo to an input 46*a* of an AND gate 46. The other input 46*b* of the AND gate 46 is coupled to receive a source voltage Vcc. The output of the AND gate 46 is coupled to the differentiating circuit 32 which includes a capacitor 50 and a resistor 52 and which generates an output voltage Vf. As shown, a junction between the capacitor 50 and the resistor 52 is coupled to the input 34*a* of the wave-shaping circuit 30 via a diode 54, while one terminal of the resistor 52 is coupled to one terminal of a resistor 56 and the source voltage Vcc. The resistor 56 is arranged to normally apply a high level voltage to the input 34*a* of the wave-shaping circuit 30.

The operation of the FIG. 1 arrangement will be discussed with reference to FIG. 2 in which there is shown a waveform of each of the above-mentioned voltages Va, Vb, Vc, Vd, Ve, Vo and Vf. It should be noted that inherent time delays between the occurrences of the voltages are not shown in FIG. 2 merely for the convenience of simplification. Further, characters "H" and "L" parenthesized in FIG. 2, denote high and low levels of the corresponding voltage, respectively.

Before the switch 22 is closed at time T1, Va assumes a low level and hence the output Vb of the comparator 24 takes a low level. On the other hand, each of the input terminal 34*a* and the differentiating circuit 32 receives the constant voltage Vcc, and accordingly each of Vc and Vf assumes a high level. This means that the output Vd of the wave-shaping circuit (Schmitt trigger) 30 assumes a high level before T1. Consequently, as the output Ve of the AND gate 40 assumes a low level under such conditions, the relay 10 remains inoperative. Thus, the output Vo of the relay 10 assumes a low level.

When the switch 22 is closed at a time point T1, a rapidly rising Va potential causes the comparator's output Vb to assume a high level, whereby the AND gate 40 generates a high logic level (Ve). This in turn induces the relay driving transistor 42 to be rendered conductive. As a result the relay armature 18 switches over to the ON position contact 16. As a consequence, the output Vo of the relay 10 assumes a high level. These conditions are maintained as long as the relay armature 18 remains in the ON position thereof. The sequence of occurrences of the voltages Va, Vb, Vc and Vo are denoted by waved solid lines (a) to (c) at the time point T1 as well as during a short time duration thereafter.

It is assumed that the relay armature 18 is forcibly driven, at a time point T2, to the OFF position contact 16 due to an externally applied impact or the like. If this happens, the output Vo of the relay 10 falls suddenly and hence the output Vf of the differentiating circuit 32

Figure 2:
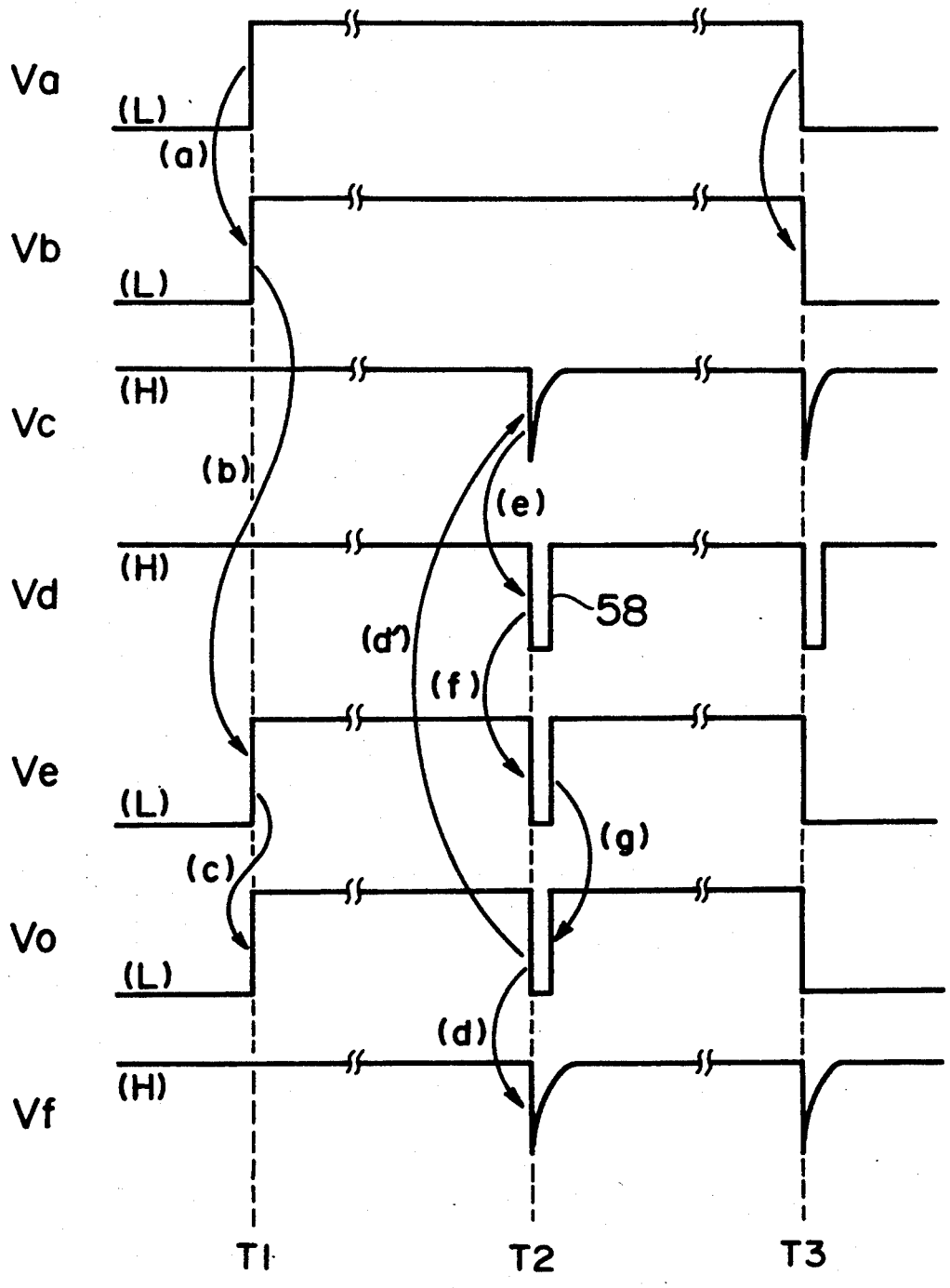
FIG. 2 is a timing chart for describing the operation of the FIG. 1 arrangement.

(also Vc) changes as illustrated in FIG. 2. In response to the abrupt fall of the relay output Vo, the Schmitt trigger 30 outputs a pulse (denoted by a reference numeral 58 in FIG. 2), whereby the output Ve of the AND gate 40 rapidly falls and thereafter rapidly rises. The transistor 42 is therefore temporarily rendered non-conductive for a short time interval. In response to the rising edge of Ve, a rapidly rising voltage is again applied to the contact controlling circuit 12, and hence the relay armature 18 is again induced to switch to the ON position contact 14. The sequence of occurrences of the voltages Vo, Vf, Vc and Vd are denoted by waved solid lines (d) to (g) at the time T2 as well as during a short time period thereafter. e Thereafter, when the switch 22 is open at time T3, a rapidly falling potential of the voltage Va causes the comparator's output Vb to assume a low level, whereby the AND gate 40 generates a low logic level (Ve). This causes the relay driving transistor 42 to be rendered non-conductive and results in the relay armature 18 switching over to the OFF position contact 16. As a consequence, the output Vo of the relay 10 becomes zero (viz., low level). It should be noted that, although each of the voltages Vc, Vd, and Vf changes as illustrated in response to the fast falling of Va, these phenomena are not concerned with this invention.

Figure 3:
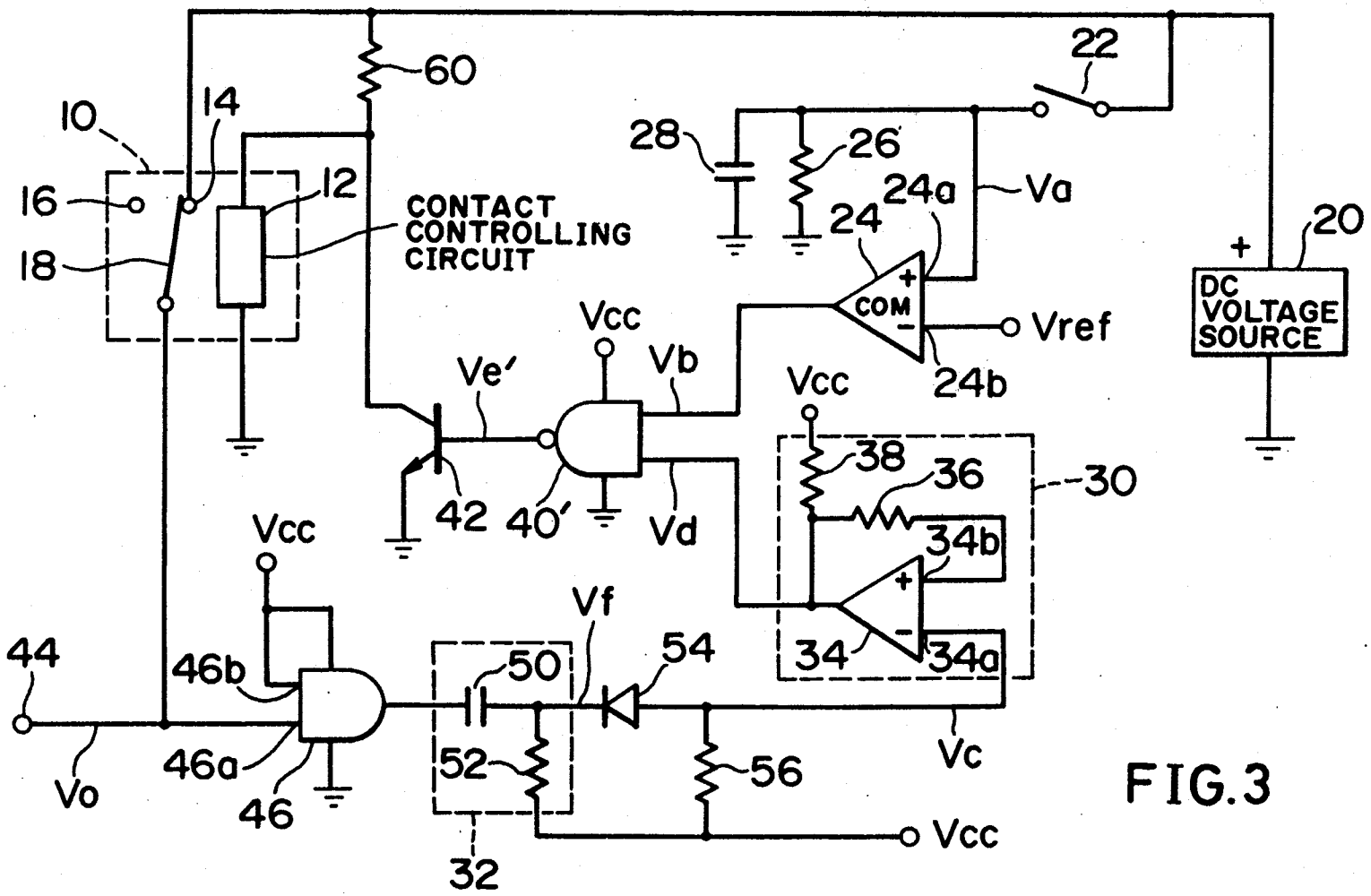
FIG. 3 is a block diagram showing a variant of the embodiment shown in FIG. 1.

Reference is now made to FIG. 3, wherein a variant of the embodiment shown in FIG. 1 is illustrated in block diagram form.

The arrangement of FIG. 3 differs from that of FIG. 1 in that: (a) the contact controlling circuit 12 is coupled to the DC voltage source 20 via a resistor 60, (b) a collector of the relay driving transistor 42 is coupled to a junction between the controlling circuit 12 and the resistor 60, (c) an NAND gate 40' is provided in place of the AND gate of FIG. 1 and (d) the output of the NAND gate 40' is denoted by Ve'. The remaining portions of the FIG. 3 arrangement are identical to the corresponding portions of FIG. 1, and hence further descriptions thereof will be omitted for brevity.

The relay 10 of FIG. 3 is also energized by a rapidly rising voltage and is rendered inoperative by a rapidly falling voltage, both applied to the contact controlling circuit 12 from the DC voltage source 20 under the control of the switch 22.

Figure 4:
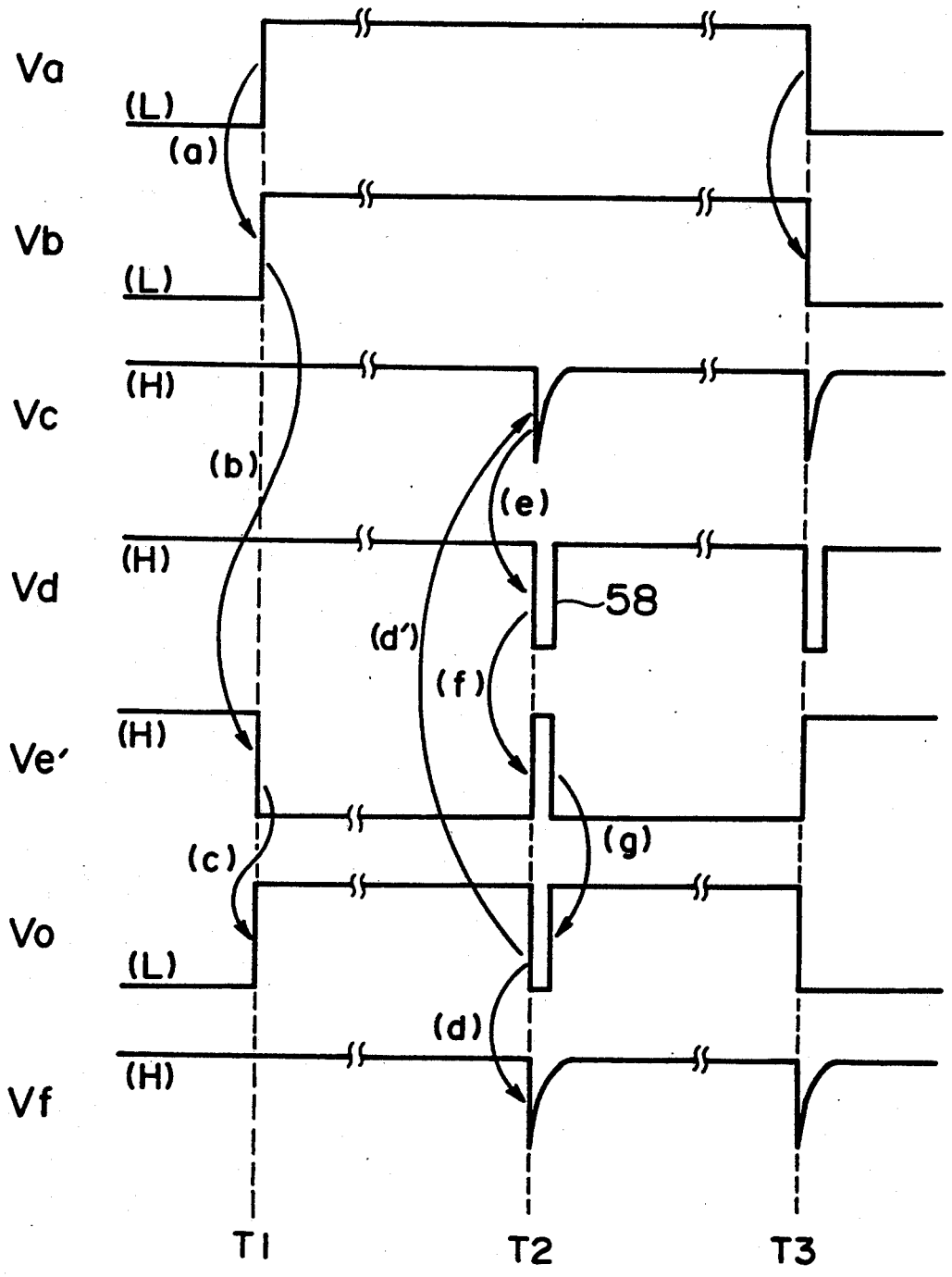
FIG. 4 is a timing chart for describing the operation of the FIG. 3 arrangement.

FIG. 4 is a timing chart which shows a waveform of each of the voltages Va, Vb, Vc, Vd, Ve', Vo and Vf. It should be noted that the voltage levels of Ve' are inverted as compared with Ve (FIG. 2). Other than this the operation is exactly the same as shown in FIG. 2. The operation of the arrangement shown in FIG. 3 is clearly understood from the foregoing descriptions regarding the FIG. 1 arrangement, and hence further discussions of FIGS. 3 and 4 are deemed unnecessary to those skilled in the art.

While the foregoing description describes one embodiment according to the present invention and one variant thereof, the various alternatives and modifications possible without departing from the scope of the present invention, which is limited only by the appended claims, will be apparent to those skilled in the art.

What is claimed is:

1. A relay circuit comprising:

a switch coupled to a direct current voltage source;

a latch-relay including a relay armature and a contact controlling means, said relay armature being switched over between on and off positions thereof in response to voltage changes induced by said switch and applied to said contact controlling means;

output voltage sensing means including a differentiating circuit which is responsive to an abrupt falling in potential at an output of said latch-in relay due to switching from said on position to said off position of said relay armature and which generates a control signal representative of said abrupt falling in potential; and relay controlling means coupled to said switch and coupled to receive said control signal, said relay controlling means including a wave-shaping circuit which generates a rectangular pulse in response to said control signal, said relay controlling means using said rectangular pulse for changing said relay armature from the off position to the on position in the event that said switch remains closed.

2. A relay circuit as claimed in claim 1, wherein said output voltage sensing means includes:

a gate circuit having first and second inputs, said first input being coupled to said output of said latch-in relay and said second input receiving a predetermined voltage, said gate circuit outputting a first signal in response to said abrupt falling in potential at the output of said latch-in relay;

and wherein said differentiating circuit is coupled to said gate circuit and generates said control signal indicating said abrupt falling in potential in response to said first signal.

3. A relay circuit as claimed in claim 2, wherein said gate circuit is an AND gate.

4. A relay circuit as claimed in claim 1, wherein said relay controlling means includes:

a comparator coupled to said switch and selectively outputting one of predetermined levels in response to closing and opening of said switch;

a gate circuit coupled to said wave-shaping circuit and coupled to said comparator for generating a second signal whose voltage level changes in response to said rectangular pulse; and a relay driver, said relay driver being coupled to said gate circuit and restoring the on position of said relay armature, said relay driver acting through said contact controlling means in response to said second signal.

5. A relay circuit as claimed in claim 4, wherein said wave-shaping circuit is a Schmitt trigger and said gate circuit is an AND gate.

6. A relay circuit as claimed in claim 4, wherein said wave-shaping circuit is a Schmitt trigger and said gate circuit is a NAND gate.

7. A relay circuit comprising a switch coupled to a direct current voltage source;

a latch-in relay including a relay armature and a contact controlling means, said relay armature being switched over between on and off positions thereof in response to voltage changes induced by said switch and applied to said contact controlling means;

a first gate circuit having first and second inputs, said first input being coupled to an output of said latch-in relay and said second input receiving a predetermined voltage, said gate circuit outputting a first signal in response to an abrupt falling in potential at the output of said latch-in relay;

a differentiating circuit coupled to said first gate circuit and generating a control signal indicative of said abrupt falling in potential in response to said first signal;

a comparator coupled to said switch and selectively outputting one of predetermined levels in response to a closing and opening of said switch;

a wave-shaping circuit coupled to said differentiating circuit and generating a rectangular pulse in response to said control signal indicating said abrupt falling in potential;

a second gate circuit coupled to said wave-shaping circuit and coupled to said comparator for generating a second signal whose voltage level changes in response to said rectangular pulse; and a relay driver coupled to said second gate a circuit and restoring the on position of said relay armature through said contact control means in response to said second signal.

8. A relay circuit as claimed in claim 7, wherein said first gate circuit is an AND gate.

9. A relay circuit as claimed in claim 7, wherein said wave-shaping circuit is a Schmitt trigger and said second gate circuit is an AND gate.

10. A relay circuit as claimed in claim 7, wherein said wave-shaping circuit is a Schmitt trigger and said second gate circuit is a NAND gate.

* * * * *